US008166702B1

(12) United States Patent
Laface

(10) Patent No.: US 8,166,702 B1
(45) Date of Patent: May 1, 2012

(54) TREE STAND APPARATUS

(76) Inventor: Ralph Laface, Richmond Hill (CA)

( * ) Notice: Subject to any disclaimer, the term of this patent is extended or adjusted under 35 U.S.C. 154(b) by 0 days.

(21) Appl. No.: 12/983,437

(22) Filed: Jan. 3, 2011

(51) Int. Cl.
*A47G 33/12* (2006.01)

(52) U.S. Cl. ..... 47/40.5

(58) Field of Classification Search ..... 47/40.5; *A47G 33/12*
See application file for complete search history.

(56) References Cited

U.S. PATENT DOCUMENTS

| | | | | |
|---|---|---|---|---|
| 1,160,698 | A | 11/1915 | Diederichs | |
| 1,846,891 | A | 2/1932 | Miller | |
| 3,411,740 | A * | 11/1968 | Schulz | 47/40.5 |
| 4,825,586 | A * | 5/1989 | Coppedge | 47/40.5 |
| 5,398,444 | A * | 3/1995 | Murray | 47/40.5 |
| 6,088,960 | A | 7/2000 | Hartzog | |
| 2009/0193713 | A1 * | 8/2009 | Limber et al. | 47/40.5 |

FOREIGN PATENT DOCUMENTS

| | | | |
|---|---|---|---|
| DE | 10117145 | A1 * | 10/2001 |
| WO | WO 03056983 | A1 * | 7/2003 |
| WO | WO 03059132 | A1 * | 7/2003 |

* cited by examiner

*Primary Examiner* — Son T Nguyen
*Assistant Examiner* — Shadi Baniani

(57) ABSTRACT

The tree stand apparatus provides lateral support and a large reservoir created by the conical shape enables fewer fillings of the apparatus. The numerous transfer orifices ensure that clogging especially typical of evergreen tree stands, does not occur, as full communication exists between the tree cylinder and the reservoir. The ability to easily drain and refill the apparatus ensures fresh water supply as well as supply of nutrients that further enhance tree livelihood. Problems of water drainage typical of after-use of a tree stand are negated by the valved drain bib that is disposed immediately adjacent to the bottom of the reservoir, thereby ensuring full drainage. The apparatus provides fill holes that are diametrically opposed, with one fill hole radialy aligned with a float that slides vertically on a float slide to enable exterior viewing of internal water level.

3 Claims, 4 Drawing Sheets

TREE STAND APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Tree stands, especially those used for Christmas trees, are almost irreplaceable in their convenience and tree preservation role. The present apparatus provides unique advantages in supporting such trees and ensuring their hydration so that a tree may preserve its beauty and lively nature for a long period of time.

FIELD OF THE INVENTION

The tree stand apparatus relates especially to a Christmas tree stand with water supply.

SUMMARY OF THE INVENTION

The general purpose of the tree stand apparatus, described subsequently in greater detail, is to provide a tree stand apparatus which has many novel features that result in an improved tree stand apparatus which is not anticipated, rendered obvious, suggested, or even implied by prior art, either alone or in combination thereof.

To attain this, the tree stand apparatus provides numerous features important to tree hydration function as well as tree support. The wide bottomed conical stand provides lateral support. The large reservoir created by the conical shape enables fewer fillings of the apparatus. The numerous transfer orifices ensure that clogging especially typical of evergreen tree stands, does not occur. As clogging is negated, transfer of water to and from the reservoir to the cylinder and to the lower chamber is guaranteed. Further, the bottom transfer orifices importantly ensure water transfer even with low reservoir water level. With the guarantee of water transfer, a tree does not become dehydrated and therefore is slow to shed needles or become brittle. Further, the ability to easily drain and refill the apparatus ensures fresh water supply as well as supply of nutrients that further enhance tree livelihood. Problems of water drainage typical of after-use of a tree stand are negated by the valved drain bib that is disposed immediately adjacent to the bottom of the reservoir, thereby ensuring full drainage.

Another common issue with trees is trying to determine if the reservoir is adequately filled. The apparatus provides fill holes that are diametrically opposed, with one fill hole radialy aligned with a float that slides vertically on a float slide. The float slide has upper and lower rounded abutments that prevent float sticking. A user can easily view float level through one of the orifices to determine fill needs of the reservoir.

The larger center orifice within the cylinder on the cylinder platform provides for improved tree support, especially if a tree is conically sharpened somewhat. The knurled clamp bolts are easily turned, and the flared inner ends negate cutting into a trunk, a problem common to most retaining bolts.

Thus has been broadly outlined the more important features of the improved tree stand apparatus so that the detailed description thereof that follows may be better understood and in order that the present contribution to the art may be better appreciated.

An object of the tree stand apparatus is to properly support a tree.

Another object of the tree stand apparatus is to clamp a tree within without trunk damage.

A further object of the tree stand apparatus is to hydrate a tree.

An added object of the tree stand apparatus is to provide for easy water addition.

And, an object of the tree stand apparatus is to provide for easy water drainage.

Still another object of the tree stand apparatus is to provide for external viewing of internal water level.

These together with additional objects, features and advantages of the improved tree stand apparatus will be readily apparent to those of ordinary skill in the art upon reading the following detailed description of presently preferred, but nonetheless illustrative, embodiments of the improved tree stand apparatus when taken in conjunction with the accompanying drawings.

DETAILED DESCRIPTION OF THE DRAWINGS

With reference now to the drawings, and in particular FIGS. 1 through 5 thereof, the principles and concepts of the tree stand apparatus generally designated by the reference number 10 will be described.

Figure 2:
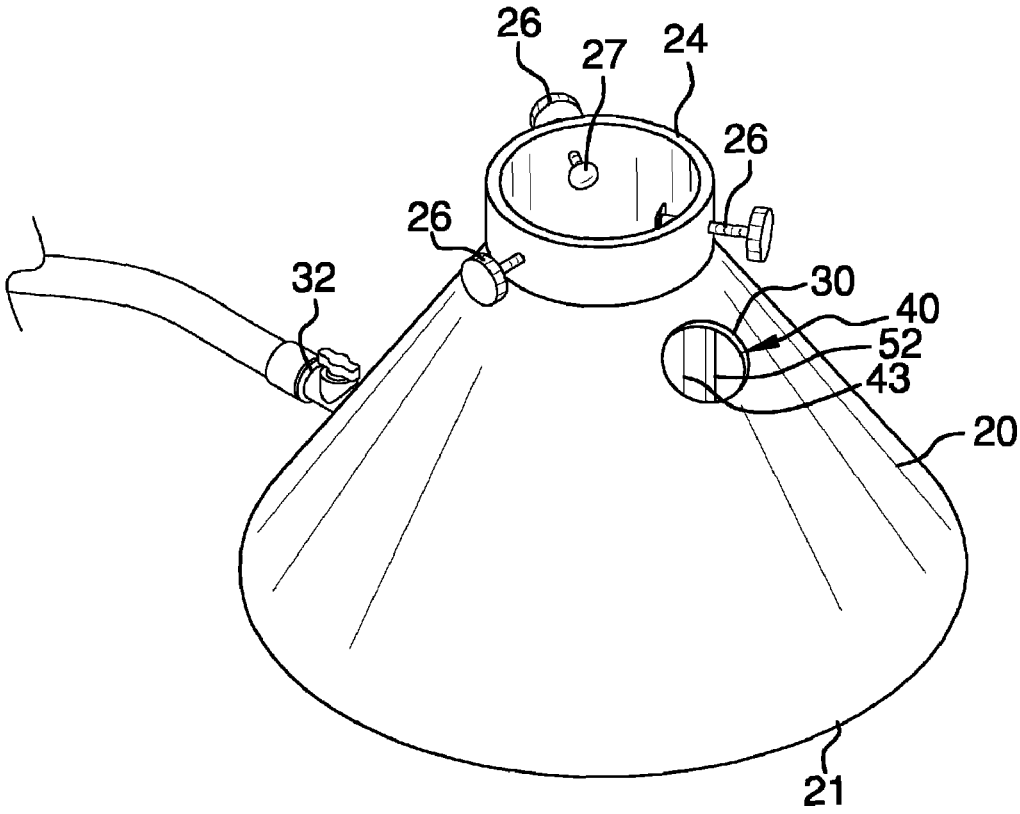
FIG. 2 is a perspective view.

Referring to FIG. 2, the apparatus 10 partially comprises the conical stand 20 having a bottom 21. The collar 24 is disposed upwardly on the stand 20.

Figure 3:
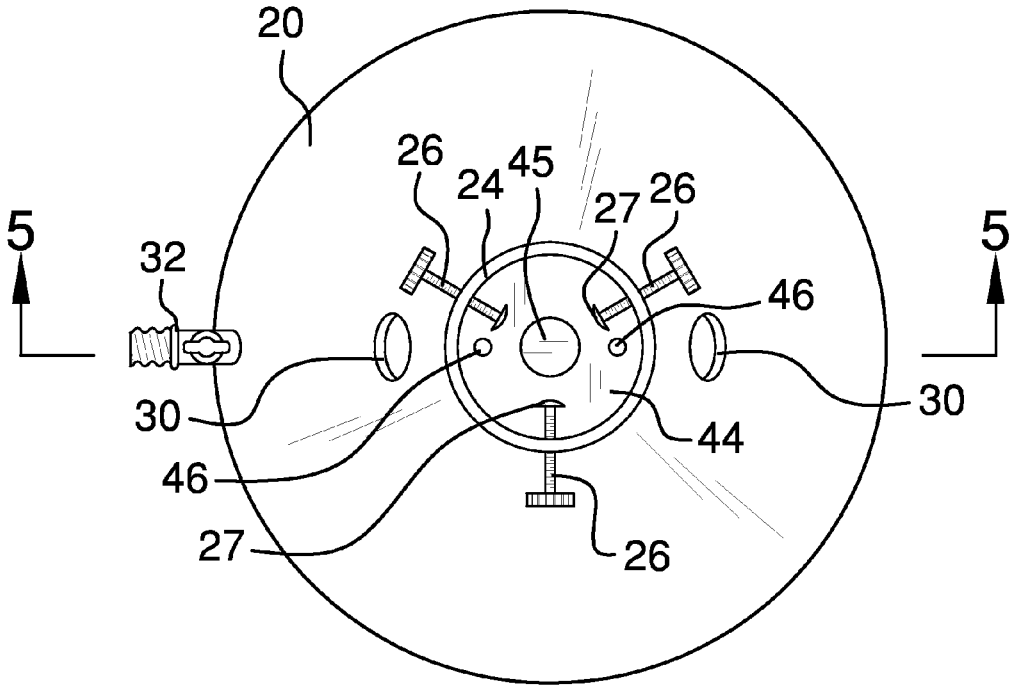
FIG. 3 is a top plan view.

Referring to FIG. 3, the plurality of spaced apart knurled clamp bolts 26 is disposed radialy within the collar 24. Each knurled clamp bolt 26 has an inwardly disposed flared inner end 27.

Figure 5:
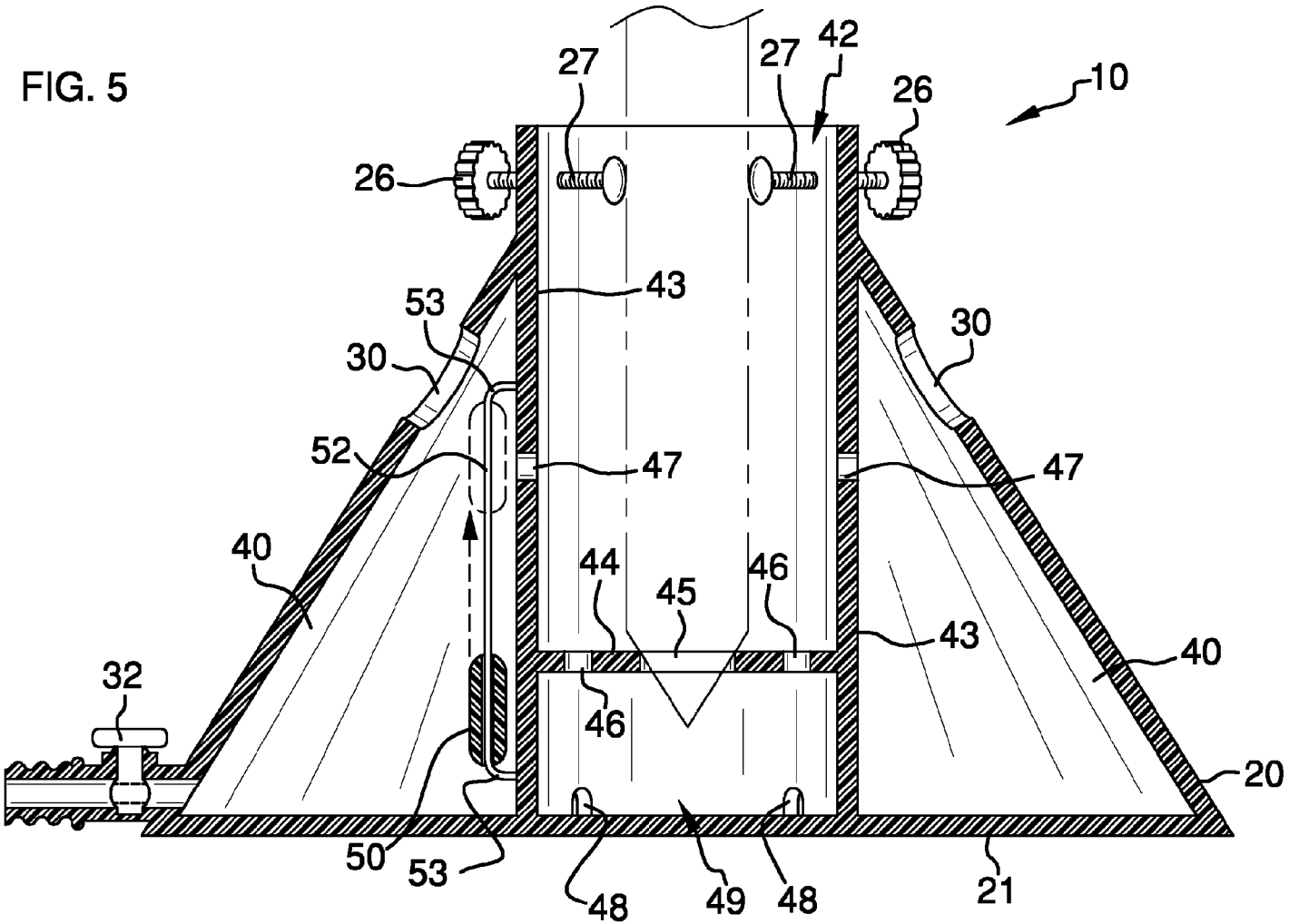
FIG. 5 is a cross sectional view of FIG. 3, taken along the line 5-5.

Referring to FIG. 5, the cylinder 42 is disposed downwardly from the collar 24.

Referring to FIG. 3 and again to FIG. 5, the cylinder platform 44 downwardly defines the cylinder 42. The center orifice 45 is disposed centrally within the platform 44. The cylinder 42 is defined outwardly by the wall 43. The lower chamber 49 is disposed below the cylinder platform 44. The lower chamber 49 shares the cylinder 42 wall 43. The lower chamber 49 is disposed between the cylinder platform 44 and the conical stand 20 bottom 21.

Referring again to FIG. 5, the reservoir 40 is disposed inwardly within the conical stand 20 and without the cylinder 42 and the lower chamber 49.

Figure 4:
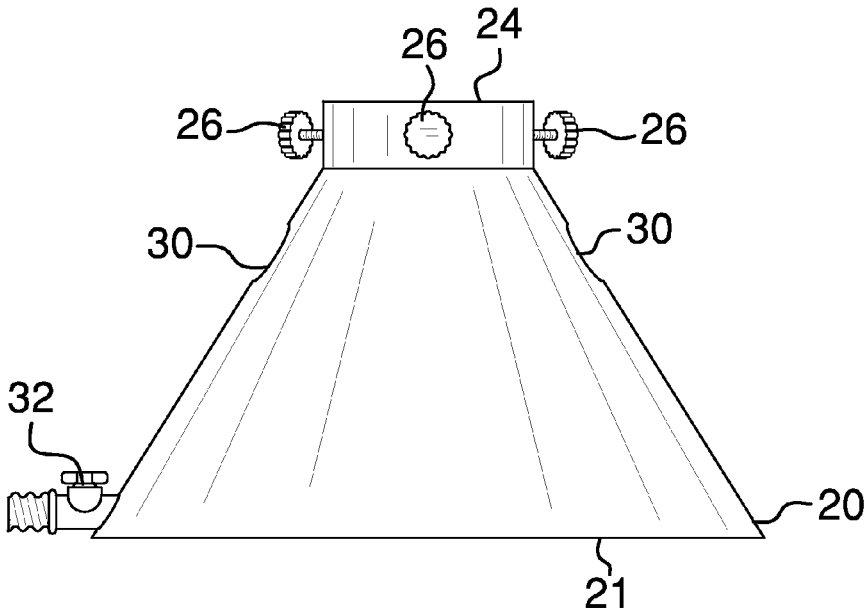
FIG. 4 is a lateral elevation view.

Referring to FIG. 4, the pair of diametrically disposed orifices 30 is disposed within the conical stand 20 below and proximal to the collar 24.

Referring again to FIGS. 2 and 5, the float slide 52 is disposed externally on the wall 43. The float slide 52 is partially upwardly and downwardly defined by rounded abutments 53 that prevent float 50 sticking in either the upward or downward position. The float slide 52 is in radial alignment with one of the orifices 30 so that float 50 position viewing is available to a user, thereby availing the user of water level within the reservoir 40. The float slide 52 is affixed to the lower chamber 49 wall 43 and to the cylinder 42 wall 43. The float 50 is slideably disposed on the float slide 52.

Referring again to FIG. 5, the plurality of horizontal transfer orifices 47 is disposed diametrically within the cylinder 42 wall 43 and connect the cylinder 42 to the reservoir 40. The plurality of vertical transfer orifices 46 connect the cylinder 42 to the lower chamber 49. The plurality of downwardly disposed bottom transfer orifices 48 connect the lower chamber 49 to the reservoir 40.

Referring again to FIGS. 1 and 5, the valved drain bib 32 is disposed on the conical stand 20 immediately adjacent to the bottom 21. The valved drain bib 32 is in communication with the reservoir 40.

Figure 1:
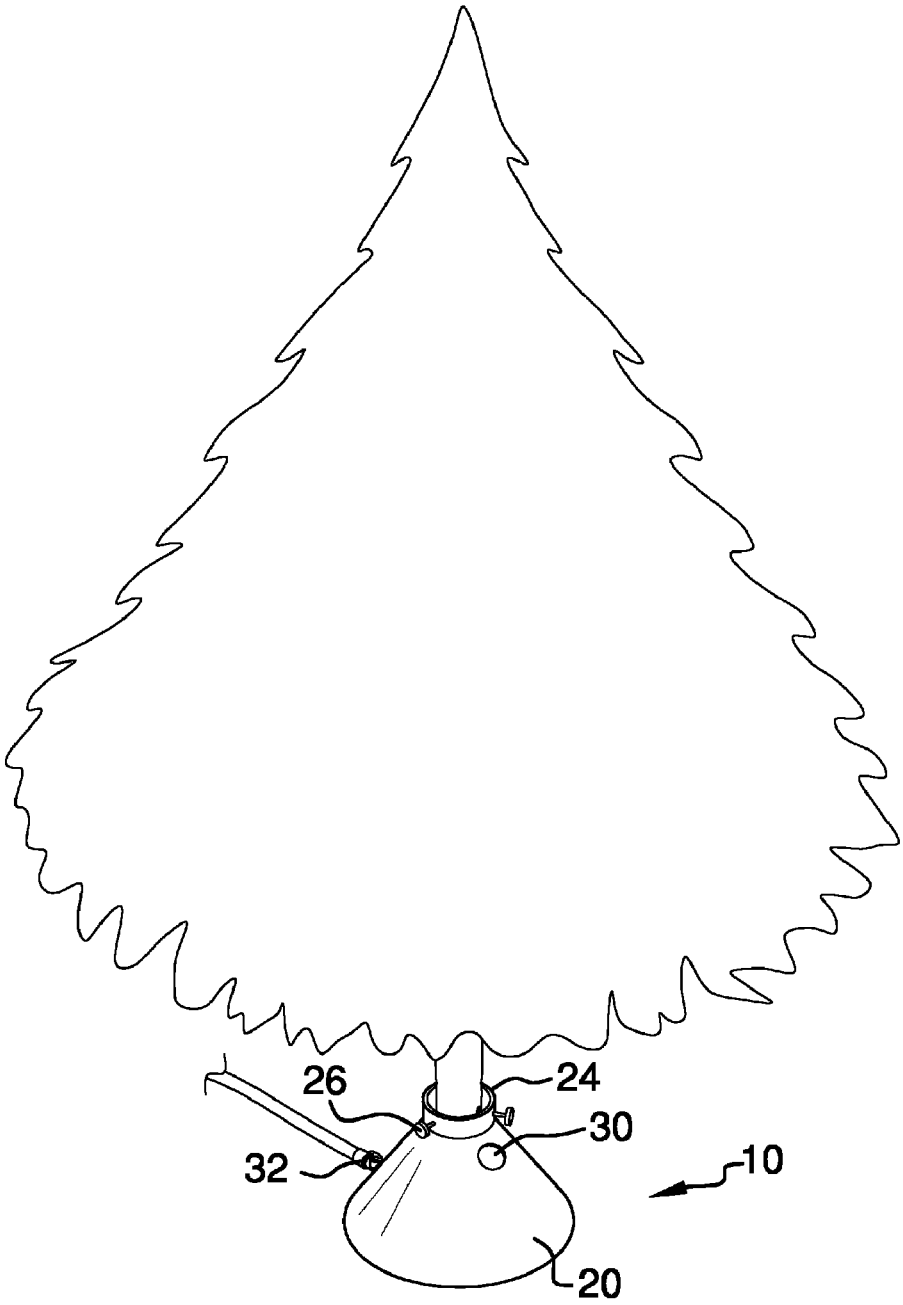
FIG. 1 is a perspective view, in use.

Referring to FIG. 1, the wide bottom 21 properly supports the tree held within the cylinder 42. The valved drain bib 32 is connected to an existing hose.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the tree stand apparatus may be used.

What is claimed is:

1. A tree stand apparatus comprising, in combination:

a conical stand having a bottom;

a collar disposed upwardly on the conical stand;

a plurality of spaced apart knurled clamp bolts disposed radialy within the collar, each knurled clamp bolt having an inwardly disposed flared inner end;

a cylinder disposed downwardly from the collar;

a cylinder platform downwardly defining the cylinder, the cylinder defined outwardly by a wall;

a center orifice disposed centrally within the platform;

a lower chamber disposed below the cylinder platform, the lower chamber disposed between the cylinder platform and the conical stand bottom;

a reservoir disposed inwardly within the conical stand and without the cylinder and the lower chamber;

a valved drain bib disposed on the conical stand immediately adjacent to the bottom, the valved drain bib in communication with the reservoir;

a pair of diametrically disposed orifices, each orifice disposed within the conical stand below and proximal to the collar;

a float slide disposed externally on the wall, the float slide partially upwardly and downwardly defined by rounded abutments, the float slide in radial alignment with one of the orifices, the float slide affixed to the lower chamber wall and to the cylinder wall;

a float slideably disposed on the float slide;

whereby the float is externally visible through one of the orifices;

a plurality of horizontal transfer orifices disposed diametrically within the cylinder wall connecting the cylinder to the reservoir;

a plurality of vertical transfer orifices connecting the cylinder to the lower chamber.

2. The apparatus according to claim 1 wherein the lower chamber further shares a wall with the cylinder wall.

3. A tree stand apparatus comprising, in combination:

a conical stand having a bottom;

a collar disposed upwardly on the conical stand;

a plurality of spaced apart knurled clamp bolts disposed radialy within the collar, each knurled clamp bolt having an inwardly disposed flared inner end;

a cylinder disposed downwardly from the collar;

a cylinder platform downwardly defining the cylinder, the cylinder defined outwardly by a wall;

a center orifice disposed centrally within the platform;

a lower chamber disposed below the cylinder platform, the lower chamber disposed between the cylinder platform and the conical stand bottom, the lower chamber sharing the cylinder wall;

a reservoir disposed inwardly within the conical stand and without the cylinder and the lower chamber;

a valved drain bib disposed on the conical stand immediately adjacent to the bottom, the valved drain bib in communication with the reservoir;

a pair of diametrically disposed orifices, each orifice disposed within the conical stand below and proximal to the collar;

a float slide disposed externally on the wall, the float slide partially upwardly and downwardly defined by rounded abutments, the float slide in radial alignment with one of the orifices, the float slide affixed to the lower chamber wall and to the cylinder wall;

a float slideably disposed on the float slide;

whereby the float is externally visible through one of the orifices;

a plurality of horizontal transfer orifices disposed diametrically within the cylinder wall connecting the cylinder to the reservoir;

a plurality of vertical transfer orifices connecting the cylinder to the lower chamber;

a plurality of downwardly disposed bottom transfer orifices connecting the lower chamber to the reservoir.

* * * * *